United States Patent [19]

Wilkinson

[11] Patent Number: 4,715,296

[45] Date of Patent: Dec. 29, 1987

[54] UTILITY BENCH

[76] Inventor: William T. Wilkinson, c/o Connolly & Hutz, P.O. Box 2207, 1220 Market Bldg., Wilmington, Del. 19899-2207

[21] Appl. No.: 847,672

[22] Filed: Apr. 3, 1986

[51] Int. Cl.[4] ..... A47B 3/02

[52] U.S. Cl. ..... 108/116; 108/132

[58] Field of Search ..... 108/132, 106, 116, 107, 108/96; 248/188.6, 188.2, 188.1

[56] References Cited

U.S. PATENT DOCUMENTS

| | | | |
|---|---|---|---|
| 109,918 | 12/1870 | Mallory | 108/116 |
| 332,404 | 12/1885 | Lerch | 108/116 |
| 865,637 | 9/1907 | Foster | 108/116 |
| 950,719 | 3/1910 | Ellsworth | 248/188.91 X |
| 1,862,010 | 6/1932 | Ehrlich | 108/106 X |
| 2,524,490 | 10/1950 | Swett | 248/188.6 X |
| 2,792,944 | 5/1957 | Drommer | 108/106 |
| 2,935,210 | 5/1960 | Cohen | 108/106 X |
| 3,056,507 | 10/1962 | Squires, Jr. et al. | 108/106 |
| 3,455,256 | 7/1969 | Prager | 108/116 |
| 3,523,702 | 8/1970 | Unti et al. | 108/106 X |
| 4,297,953 | 11/1981 | Shy | 108/132 X |
| 4,341,164 | 7/1982 | Johnson | 108/67 |
| 4,415,149 | 11/1983 | Rees | 108/116 X |

FOREIGN PATENT DOCUMENTS

| | | | |
|---|---|---|---|
| 377924 | 8/1932 | United Kingdom | 108/116 |

*Primary Examiner*—Kenneth J. Dorner
*Assistant Examiner*—José V. Chen
*Attorney, Agent, or Firm*—Connolly & Hutz

[57] ABSTRACT

An adjustable utility bench includes an elongated planar support platform. A mounting unit is secured to each end of the platform and includes a pair of legs hingedly mounted to the platform. The legs are interconnected by a brace so as to be jointly movable from its perpendicular position during use to its folded parallel position during storage. An extension is adjustably secured to each leg to vary the height of the platform.

6 Claims, 7 Drawing Figures

UTILITY BENCH

BACKGROUND OF THE INVENTION

Various utility benches exist for different purposes such as providing a step which can be used to reach otherwise inaccessible articles. Utility benches are also used as a seat or support platform. It would be desirable if a utility bench could be provided which is capable of fulfilling its intended purposes and which during periods of storage is foldable and portable for convenient carrying and storage.

SUMMARY OF THE INVENTION

An object of this invention is to provide a utility bench which meets the above needs.

A further object of this invention is to provide such a utility bench which could be used for various purposes as a support or ladder in addition to functioning as an exercise device.

In accordance with this invention, the utility bench includes a mounting unit secured to each end of a planar support platform. The mounting unit comprises a pair of legs hinged to the platform for being folded against the underside of the platform with the brace interconnecting the legs. In addition, an extension is adjustably secured to each of the legs for varying the height of the platform.

In a preferred form of this invention, the brace of each mounting unit is disposed at an angle to its legs with both braces being at opposite angles. The leg extension may be completely detachable to facilitate storage.

THE DRAWINGS

DETAILED DESCRIPTION

Figure 2:
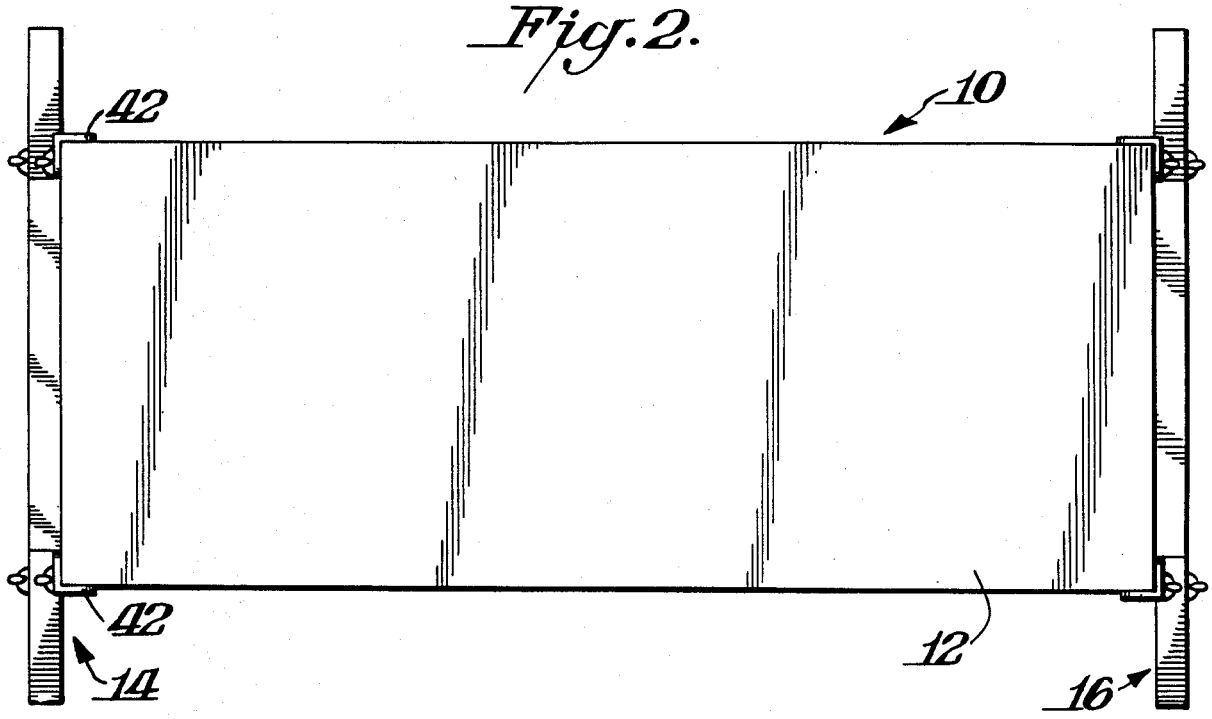
FIG. 2 is a top plan view of the utility bench shown in FIG. 1.
Figure 1:
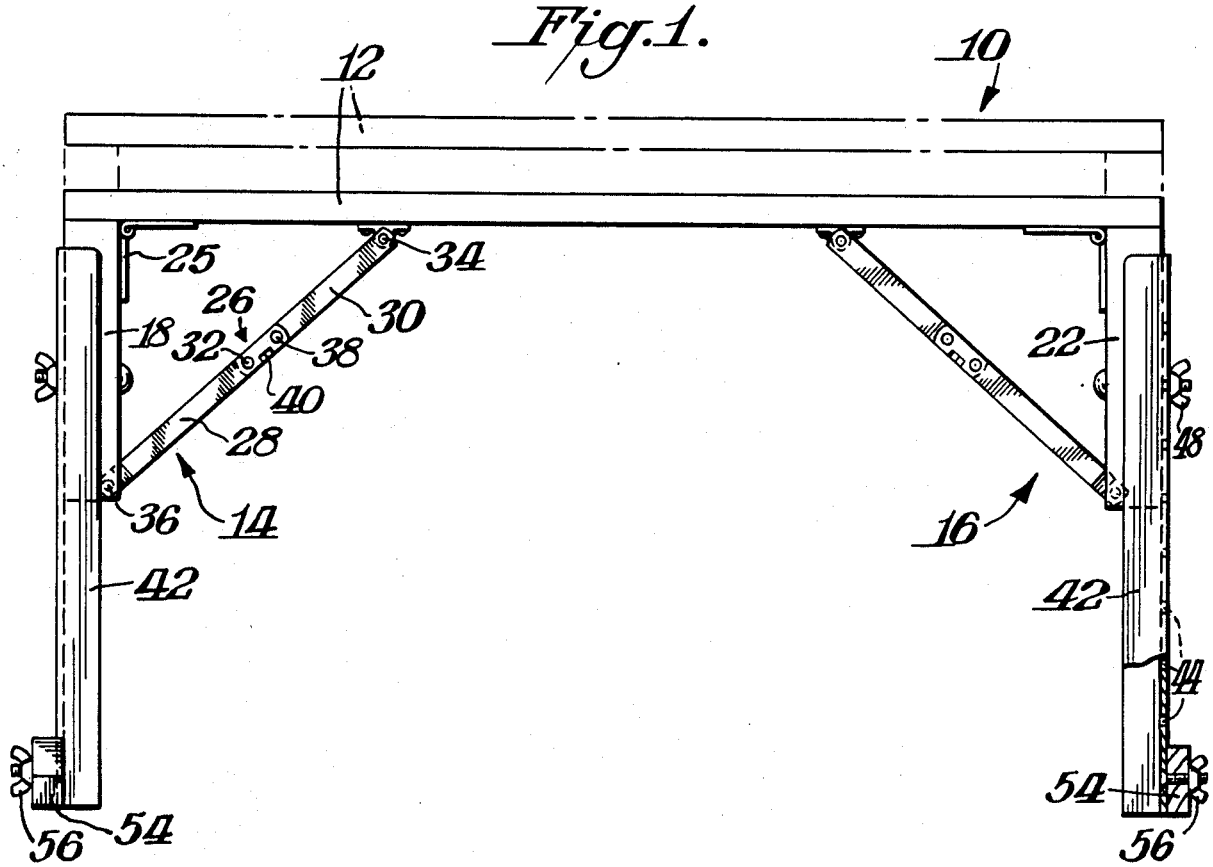
FIG. 1 is a front elevation view of a utility bench in accordance with this invention.

FIGS. 1–4 illustrate a utility bench 10 in accordance with this invention. The utility bench may be used for a number of various purposes such as a step to permit the user to reach otherwise inaccessible objects or as a support. In addition, because utility bench 10 is capable of having its height varied, utility bench 10 may function for single step climbing such as in my U.S. Pat. Nos. 4,340,218 and 4,561,652 and their various continuation-in-part applications.

Utility bench 10 comprises an elongated planar support platform 12 having a pair of spaced ends. Mounting units 14, 16 are secured to the underside of platform 12 at each end thereof. Each mounting unit comprises a pair of legs 18, 20 and 22, 24, respectively. The specific means of mounting each leg to platform 12 comprises a hinge 25 secured to a respective leg and to the platform 12. In addition, the remote end of each leg is hingedly mounted by a locking device 26 in the form of a pair of arms 28, 30 which are pivotally connected at pin 32.

Arm 30, in turn, is pivotally connected to bracket 34 secured to platform 12 while arm 28 is pivotally connected by fastener 36 to its respective leg. A locking device in the form of projections 38, 40 in arm 30 snapping into recesses in arm 28, maintain the legs in their operative position perpendicular to platform 12. By this arrangement it is possible to selectively position the legs perpendicular to platform 12 in the operative position or to fold the legs flat against the underside of platform 12.

Each leg 18, 20, 22, 24 is provided with an extension 42 made of an L-shaped angle member having perpendicular walls with a series of holes 44 along one wall thereof. Each leg in turn includes a hole through which a fastener 46 may be inserted. In this manner the hole in a respective leg could be aligned with a hole in extension 42 and then the leg and extension may be secured together by means of fastener 46. Fastener 46 may be of any suitable form such as a bolt and nut combination. As a result, by proper selection of the holes 44, it is possible to vary the height of platform 12.

Figure 3:
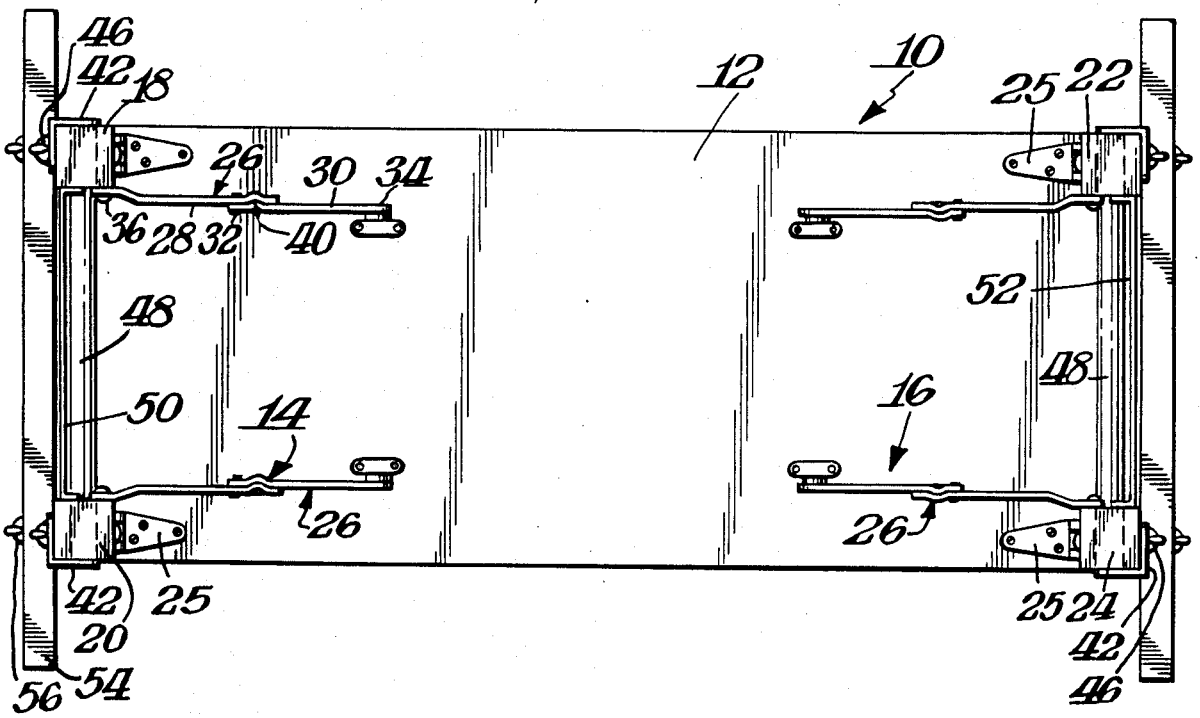
FIG. 3 is a bottom plan view of the utility bench shown in FIG. 1.
Figure 4:
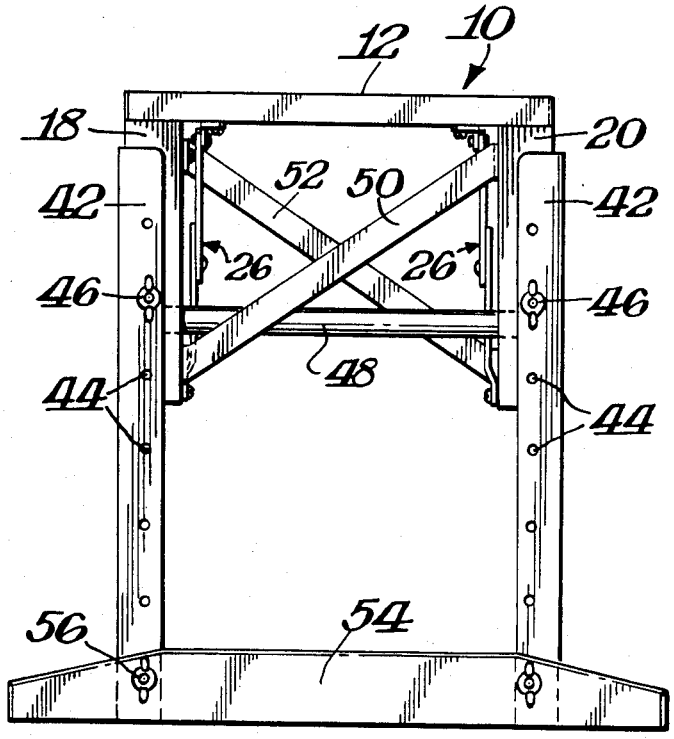
FIG. 4 is an end elevation view of the utility bench shown in FIG. 3.
Figure 7:
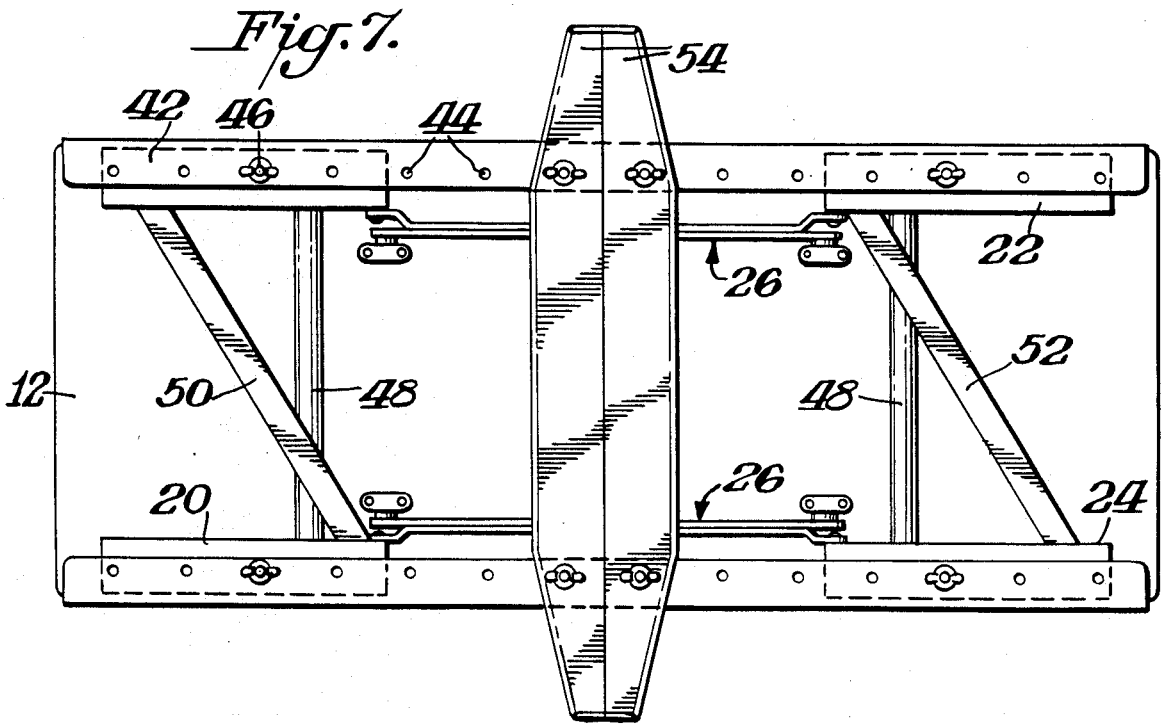

An important feature of this invention is the means utilized to provide the desired stability to device 10. This stability is achieved by interconnecting each set of legs in each mounting unit. The interconnection also provides joint movement of each set of legs between its use and storage conditions. FIG. 4, for example, illustrates a rod 48 extending horizontally between and secured to a set of legs such as by being received in openings in the legs. As shown in FIG. 3 and 7, a rod 48 would be provided for each mounting unit. In addition, a bar or brace 50 or 52 also spans a respective mounting unit. To maximize the stability of bars 50, 52, each such bar spans its respective leg by being at an angle with the angles being exactly opposite each other. Thus, as shown in FIG. 4, when viewed from the end direction, bars 50 and 52 form an X. Each bar may be secured to its respective legs in any suitable manner such as by screws.

Stability of device 10 is further enhanced by the provision of base supports or bars 54. Each base support 54 spans and is detachably connected to a pair of extensions 42. In the preferred form of this invention, each base support 54 has a notch at each end thereof for snugly receiving a respective extension. Each base support 54 also includes an opening in the notched area for alignment with the lowermost opening of extension 42 with extension 42 terminating flush with the lower surface of base support 54. Any suitable fastener 56 such as a nut and both combination may be used for detachably securing each base support 54 to a respective pair of extensions 42.

Various materials may be used for constructing device 10. Platform 12, legs 18, 20, 22, 24, rods 48 and base supports 54 may be made of wood which would add to the aesthetic nature of the device. Other suitable materials such as metal or plastic could also be used. Extensions 42 similarly may be made of any suitable material such as angle iron while the remaining components are preferably made of metal.

Figure 6:
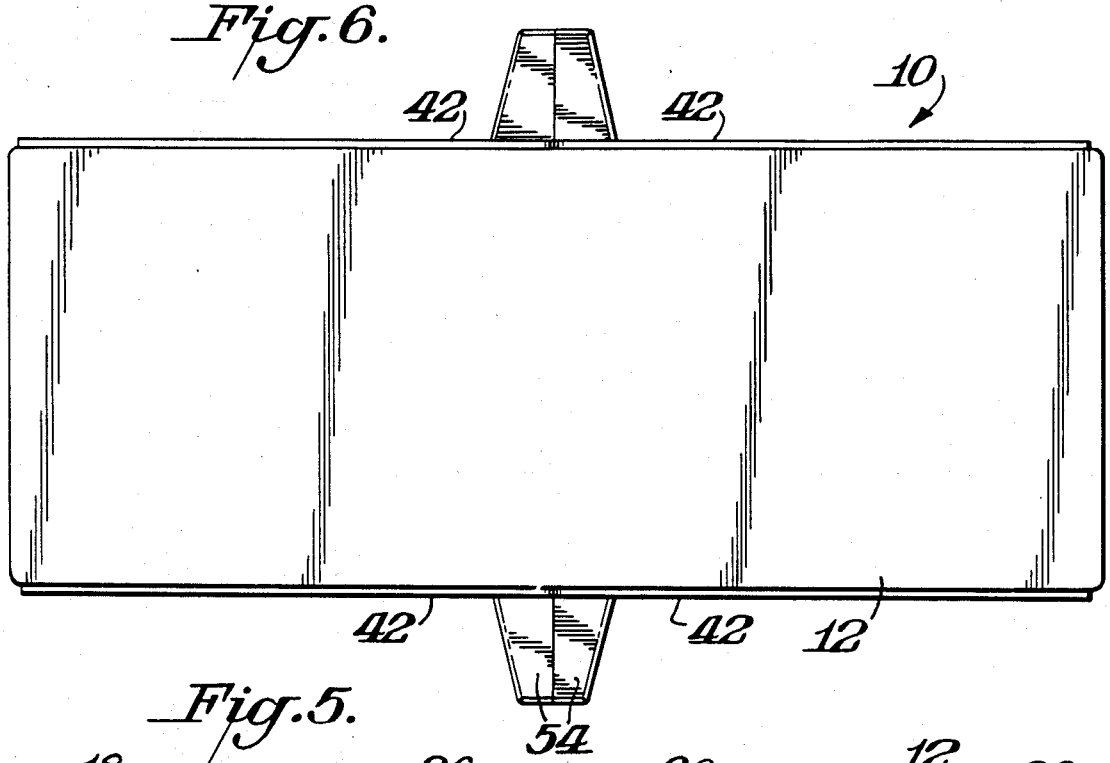
FIGS. 6 and 7 are top and bottom plan views of the utility bench shown in FIG. 5.
Figure 5:
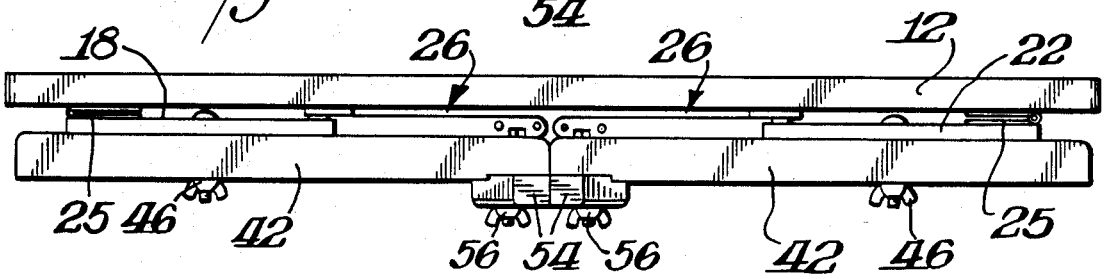
FIG. 5 is a side elevation view of the utility bench of FIGS. 1–4 in its collapsed condition.

An advantageous feature of this invention is that it lends itself to compactness during storage or periods of non-use. This is enhanced by the ready detachability of the base supports from the extensions and of the extensions from the legs. The various components, however, need not be detached in order to provide a compact stored unit. FIGS. 5–7 illustrate the arrangement of the various components while still in the assembled form but with the support units folded against the lower side of platform 12. In this manner, except for the slight extension of the base supports 54 beyond the edges of platform 12, all of the components are confined within the periphery of platform 12. The resultant unit may be inserted in a suitable box or carrying case for convenient storage or transportability.

Device 10 may be of any suitable dimensions. For example, platform 12 may be 11½ inches wide and 29 inches long and ¾ inch thick. Each leg may be 7½ inches long. Each extension 42 may be 14 inches long with the maximum effective length of each leg and extension unit being 16¾ inches. Holes 44 may be 2 inches apart except for the lowermost hole which is spaced 1½ inches from its next hole 44 and 1 inch from the end of extension 42 for terminating flush with support member 54. The 2 inch spacing of holes provides 2 inch increments of adjustability. Although not shown, a handle may be secured to platform 12 such as along an edge or near an edge on the underside to facilitate transporting device 10.

What is claimed is:

1. An adjustable utility bench for being disposed a vertical distance above a support surface comprising an elongated planar one-piece support platform having an underside and a pair of side edges and a pair of spaced ends, a mounting unit secured to each of said ends, each mounting unit comprising a pair of legs hingedly mounted to said platform by a hinging mechanism secured to the lower end of each of said legs and secured to said underside of said support platform at a location inwardly of said side edges for being folded against said underside of said platform during periods of storage, a brace interconnecting said legs whereby said legs are jointly movable between its use and storage conditions, said brace of each mounting unit being connected to its respective pair of legs at an angle thereto by said brace being connected at one end to the lower portion of one of said pair of legs and at its opposite end to the upper portion of the other of said pair of legs, said braces of both mounting units being at opposite angles to each other, an extension secured to each of said legs, adjustable securing means mounting each of said extensions to a respective leg whereby the vertical distance said extensions project away from said platform may be varied to control the height of said platform at one of at least three different fixed heights, and a support member spanning and extending laterally beyond and detachably connected to a respective pair of said extensions of each mounting unit to provide stability to said bench.

2. The bench of claim 1 wherein each of said extensions is an angle member having a pair of perpendicular walls, each of said legs having an opening extending completely therethrough, said adjustable securing means comprising a series of aligned holes in one wall of each of said extensions for selective registry with said opening of its respective leg, and a fastener extending through said opening and one of said aligned holes.

3. The bench of claim 2 wherein said support member includes a bar having a pair of notches in one surface thereof at opposite ends of said bar, a respective extension being snugly received in each of said notches, an opening extending through said bar at each of said notches in registry with an opening extending through its respective extension, and a fastener extending through each set of openings in said bar and extensions.

4. The bench of claim 3 wherein said bench is in its folded position during periods of storage, said support members extending beyond the periphery of said platform, and said support members being the only components of said bench which are beyond the periphery of said platform.

5. The bench of claim 4 wherein each of said legs is hingedly mounted to said platform by a pair of hinge units, one of said hinge units comprising a hinge secured to said underside of said platform and secured to its respective leg at the junction of said leg and said platform, the other of said hinge units comprising a pair of arms, one of said arms being pivotally secured to said underside of said platform remote from said junction, the other of said arms being pivotally secured to said leg remote from said junction, said arms being pivotally secured to each other, and locking means for selectively locking said arms together.

6. The bench of claim 5 wherein each of said mounting units further comprises a rod extending horizontally across and secured to said pair of legs.

* * * * *